US012480380B2

(12) United States Patent
Jordan et al.

(10) Patent No.: US 12,480,380 B2
(45) Date of Patent: Nov. 25, 2025

(54) INNER STRING CEMENTING SYSTEM AND METHOD

(71) Applicant: Frank's International, LLC, Houston, TX (US)

(72) Inventors: John Christopher Jordan, Houston, TX (US); Amy L. Farrar, Houston, TX (US); Juan Carlos E. Mondelli, Houston, TX (US); Steven Russell, Houston, TX (US)

(73) Assignee: FRANK'S INTERNATIONAL, LLC, Houston, TX (US)

( * ) Notice: Subject to any disclaimer, the term of this patent is extended or adjusted under 35 U.S.C. 154(b) by 127 days.

(21) Appl. No.: 18/488,209

(22) Filed: Oct. 17, 2023

(65) Prior Publication Data

US 2024/0133264 A1 Apr. 25, 2024
US 2024/0229597 A9 Jul. 11, 2024

Related U.S. Application Data

(60) Provisional application No. 63/380,066, filed on Oct. 19, 2022.

(51) Int. Cl.
*E21B 33/14* (2006.01)
*E21B 17/06* (2006.01)
(Continued)

(52) U.S. Cl.
CPC ..... *E21B 33/14* (2013.01); *E21B 17/06* (2013.01); *E21B 33/0415* (2013.01); *E21B 43/10* (2013.01)

(58) Field of Classification Search
CPC ..... E21B 33/14; E21B 17/06; E21B 33/0415; E21B 43/10; E21B 17/07
See application file for complete search history.

(56) References Cited

U.S. PATENT DOCUMENTS

| | | | | |
|---|---|---|---|---|
| 9,359,845 | B2 * | 6/2016 | Grodem | E21B 33/143 |
| 11,111,755 | B2 | 9/2021 | Bruce et al. | |
| 11,448,037 | B2 | 9/2022 | Bruce et al. | |

FOREIGN PATENT DOCUMENTS

| | | | |
|---|---|---|---|
| WO | 2004070159 | A2 | 8/2004 |
| WO | 2004072434 | A2 | 8/2004 |
| WO | 2021028689 | A1 | 2/2021 |

OTHER PUBLICATIONS

Search Report dated Mar. 19, 2024, GB Application No. GB 2315927.0, 4 pages.

(Continued)

*Primary Examiner* — Catherine Loikith
(74) *Attorney, Agent, or Firm* — MH2 Technology Law Group, LLP

(57) ABSTRACT

A cementing system includes an inner string configured to be received into a casing string in a wellbore. The cementing system also includes a stinger coupled to the inner string and configured to be received into a float shoe connected to the casing string. The cementing system also includes a first retractable joint coupled to the inner string. The retractable joint is configured to reduce in axial length so as to permit at least part of stinger to be withdrawn from engagement with the float shoe while a weight of the inner string is supported by a hanger running tool and casing hanger connected to the casing. The inner string, the stinger, and the retractable joint form at least a part of a flowpath that extends through an end of the casing string at the float shoe.

11 Claims, 7 Drawing Sheets

(51) Int. Cl.
*E21B 33/04* (2006.01)
*E21B 43/10* (2006.01)

(56) References Cited

OTHER PUBLICATIONS

Norwegian Office Action dated Jan. 29, 2025, NO Application No. 20231106, 5 pages.

* cited by examiner

INNER STRING CEMENTING SYSTEM AND METHOD

CROSS-REFERENCE TO RELATED APPLICATIONS

This application claims priority to U.S. Provisional Patent Application No. 63/380,066, filed on Oct. 19, 2022, the entirety of which is incorporated by reference.

BACKGROUND

During well construction operations in the oilfield, a casing may be deployed into the well and cemented into place. Various equipment may be used for such operations. For example, a float shoe may be attached to the lower end of a string of casing. The float shoe may have a one-way valve that permits fluid flow out through the lower end of the casing string, but generally prevents reverse flow.

FIG. 1 is generally illustrative of conventional inner string cementing assemblies used for running and cementing large diameter casing strings in subsea wells, e.g., generally the first and second (and therefore largest diameter) strings that are run into a given well. Specifically, the cementing system includes a float shoe 10 positioned at a lower end of a casing string 12 that is run into a wellbore 16. An outer annulus 18 is defined radially between the wellbore 16 and the casing string 12. As shown in FIG. 1, an inner string 14 can be located within the casing string 12, forming an inner annulus 20 radially therebetween. Fluid, such as cement, mud, seawater, etc., can then be circulated down to and through the inner string 14, through the float shoe 10, and into an outer annulus 18 between the wellbore 16 and the exterior of the casing string 12. When displacing cement into the outer annulus 18, the lower portion of the interior of the casing string 12 is typically left with residual cement 22. The residual cement is left to cure and harden, and thereby block the float shoe 10. This permits pressure-testing the casing string 12, as fluid can be pumped into the casing string, e.g., via the inner string 14. Once such activities are complete, the residual cement 22 is drilled out in order to continue advancing the wellbore 16 below the casing string 12. This generally ends this stage of the cementing operations.

SUMMARY

A cementing system is disclosed. The cementing system includes an inner string configured to be received into a casing string in a wellbore. The cementing system also includes a stinger coupled to the inner string and configured to be received into a float shoe connected to the casing string. The cementing system also includes a first retractable joint coupled to the inner string. The retractable joint is configured to reduce in axial length so as to permit at least part of stinger to be withdrawn from engagement with the float shoe while a weight of the inner string is supported by a hanger running tool and casing hanger connected to the casing. The inner string, the stinger, and the retractable joint form at least a part of a flowpath that extends through an end of the casing string at the float shoe, such fluid is permitted to flow through the inner string and the float shoe and into an outer annulus defined outside of the casing string, without flowing into an inner annulus defined between the inner string and the casing string.

A method is also disclosed. The method includes deploying an inner string including a stinger and a retractable joint into a casing string. A float shoe is connected to the casing string and permits one-way fluid communication from within the casing string to an outer annulus between a wellbore and the casing string. The method also includes receiving the stinger into the float shoe. The method also includes circulating fluid through the inner string, the stinger, and the float shoe, into the outer annulus. The fluid does not communication with an inner annulus defined between the inner string and the casing string. The method also includes retracting the retractable joint. Retracting the retractable joint causes the stinger to be withdrawn from the float shoe. The method also includes circulating fluid through the inner string and into an interior of the casing after withdrawing the stinger from within the float shoe.

BRIEF DESCRIPTION OF THE DRAWINGS

The accompanying drawing, which is incorporated in and constitutes a part of this specification, illustrates an embodiment of the present teachings and together with the description, serves to explain the principles of the present teachings. In the figures.

Figure 1:
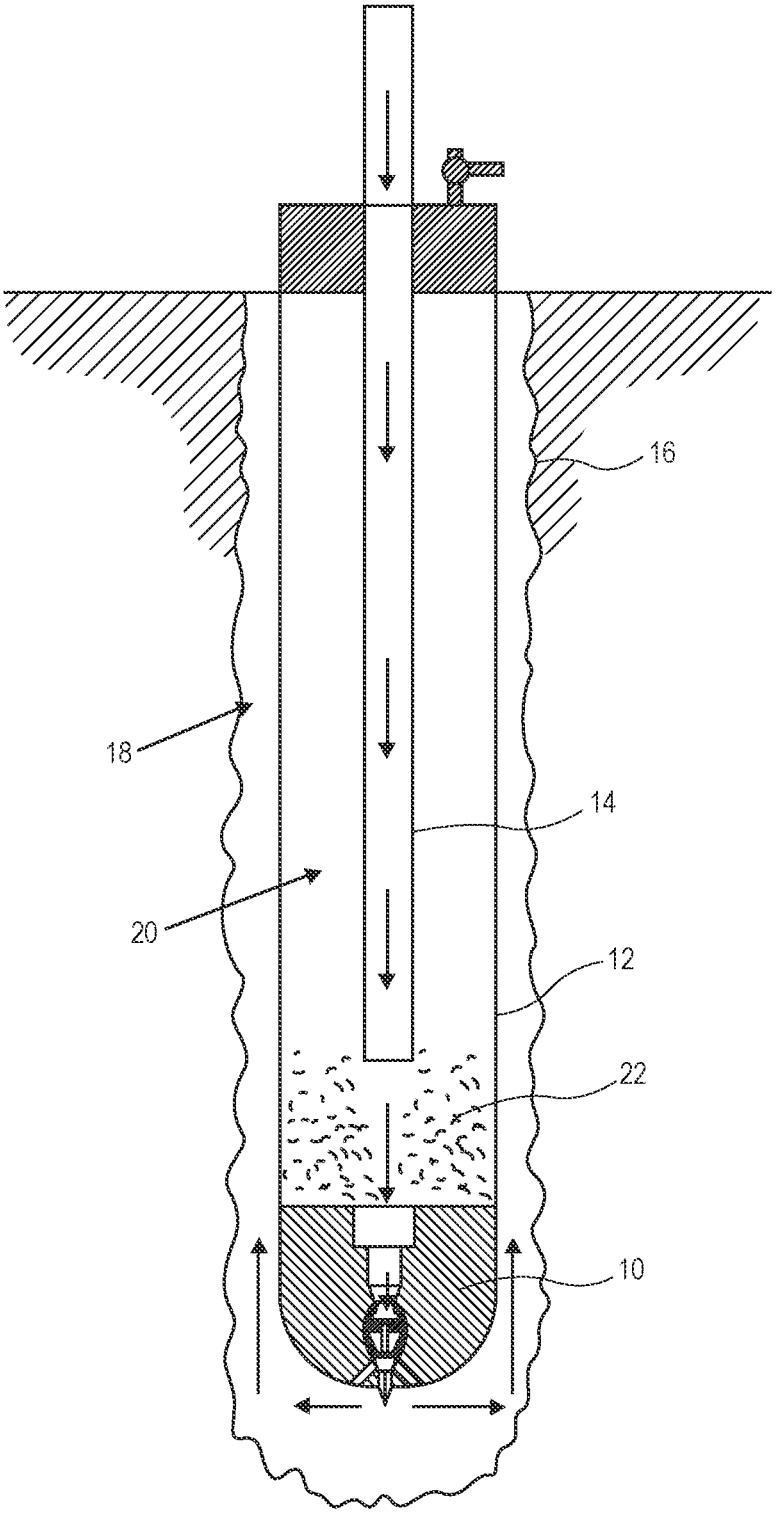
FIG. 1 (PRIOR ART)
FIG. 1 illustrates a schematic side view of a conventional inner string type cementing system.

It should be noted that some details of the figure have been simplified and are drawn to facilitate understanding of the embodiments rather than to maintain strict structural accuracy, detail, and scale.

DETAILED DESCRIPTION

Reference will now be made in detail to embodiments of the present teachings, examples of which are illustrated in the accompanying drawing. In the drawings, like reference numerals have been used throughout to designate identical elements, where convenient. The following description is merely a representative example of such teachings.

Figure 2:
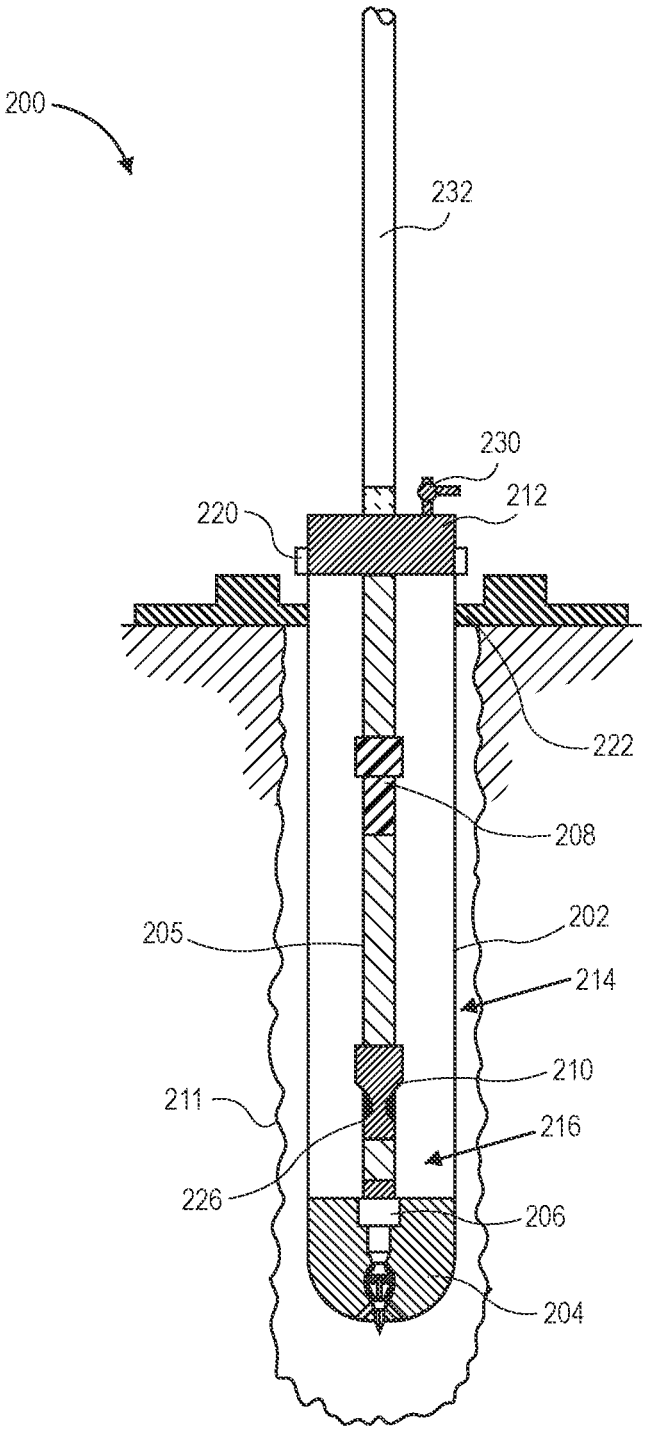
FIG. 2 illustrates a schematic side view of an inner string cementing system in a first state, as the casing string and inner sting are positioned partially in a wellbore, according to an embodiment.

FIG. 2 illustrates a side, schematic view of a cementing system 200 in a first "state", according to an embodiment. It will be appreciated that a single embodiment of the cementing system 200 may change state, e.g., by actuation of different components thereof, removing sections, reducing sizes of components, etc.

The cementing system 200 generally includes a casing string 202, a float shoe 204 positioned at a lower end of the casing string 202, and an inner string 205 deployed within the casing string 202. The casing string 202 may be deployed into a wellbore 211, and an outer annulus 214 may be defined radially between the wellbore 211 and the casing string 202. An inner annulus 216 may be defined radially between the casing string 202 and the inner string 205.

The cementing system 200 also includes a stinger 206, a slip joint 208, and a retractable joint 210. Each of these components 206, 208, 210 may be coupled to and may form part of the inner string 205. The stinger 206 may be positioned at a lower end of the inner string 205 and may be configured to be received into and seal with the float shoe 204, so as to permit fluid communication through the inner string 205 and through the float shoe 204, e.g., without the fluid proceeding into the casing string 202 and/or the inner annulus 216. A lower portion of the inner string 205, e.g., connected to and/or including the stinger 206, may be made from a PDC drillable material, and may have an emergency disconnect system that permits the lower portion to be disconnected from a remainder of the inner string 205 in certain (e.g., emergency) situations. The drillable, lower portion can then be drilled out to open the casing string 202.

The cementing system 200 may also include a casing hanger running tool 212 that connects the casing string 202 to the inner string 205 and to a landing string 232. The landing string 232 may extend to the rig at the surface, permitting control of the position of the cementing system 200 from the surface and pumping of fluid into the inner string 205, etc. Additionally, the inner string 205 is connected to (e.g., threaded into connection or "made-up to") a casing hanger 220. The casing hanger 220 may land on a shoulder 222, e.g., provided by a subsea wellhead housing with a mud mat, and thereby supports the casing string 202 in the well. Making the casing hanger running tool 212 up to the casing hanger 220 and supporting the casing hanger 220 on the shoulder 222 may permit the casing string 202 and inner string 205 to be suspended, in tension, within the wellbore 211, as will be discussed in greater detail below.

Further, the retractable joint 210 may include a ball seat 226, which may be configured to catch an obstructing member (not shown in this figure), e.g., a ball or dart, deployed thereto via the interior of the inner string 205. The retractable joint 210 may be configured to be activated upon catching the obstructing member. For example, pressure may be applied to the retractable joint 210 via the inner string 205, which, after the obstructing member is caught in the ball seat 226, may case the retractable joint 210 to retract, as will also be described in greater detail below.

The cementing system 200 may also include a vent valve 230, which may communicate with the inner annulus 216. The vent valve 230 may be closed, e.g., to permit pressure to increase in the inner annulus 216, or opened to relieve such pressure, permitting circulation of fluid through the inner string 205, into the inner annulus 216, and back out of the vent valve 230.

Figure 3:
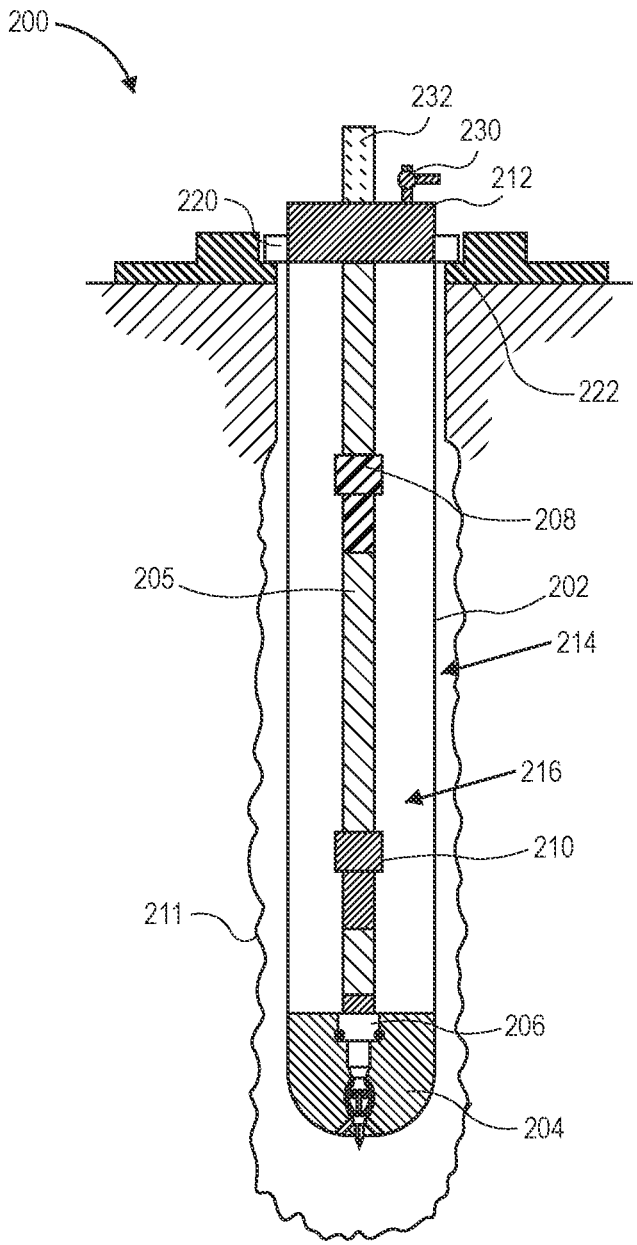
FIG. 3 illustrates a schematic side view of the cementing system in a second state, with the inner string, casing string, and casing hanger running tool made-up to a casing hanger and a casing hanger all landed out in a subsea wellhead according to an embodiment.

Proceeding to FIG. 3, there is shown the cementing system 200 in a second state, according to an embodiment. Specifically, to reach the second state (e.g., to proceed from FIG. 2 to FIG. 3), the stinger 206 is received into the float shoe 204. As noted above, the stinger 206 may form a seal with the float shoe 204 and may provide a flowpath through the inner string 205, through the float shoe 204, and into the outer annulus 214 that surrounds the casing string 202. Further, for the casing hanger running tool 212 to latch into the casing hanger 220, the inner string 205 and casing hanger running tool 212 are lowered into engagement with the hanger 220 and in order to accommodate the displacement of the running tool 212 downward, the slip joint 208 is reduced in length, as shown. For example, the slip joint 208 may react to axial loading applied and shortening axially in response to the applied loading. This reduces the overall length of the inner string 205 and permits the casing hanger running tool 212 to engage and be rotated into connection with the casing hanger 220 at the upper end of the casing string 202, while the stinger 206 remains received into the float shoe 204. The result is that the cementing system 200 is moved into the second state, as noted above.

Figure 4:
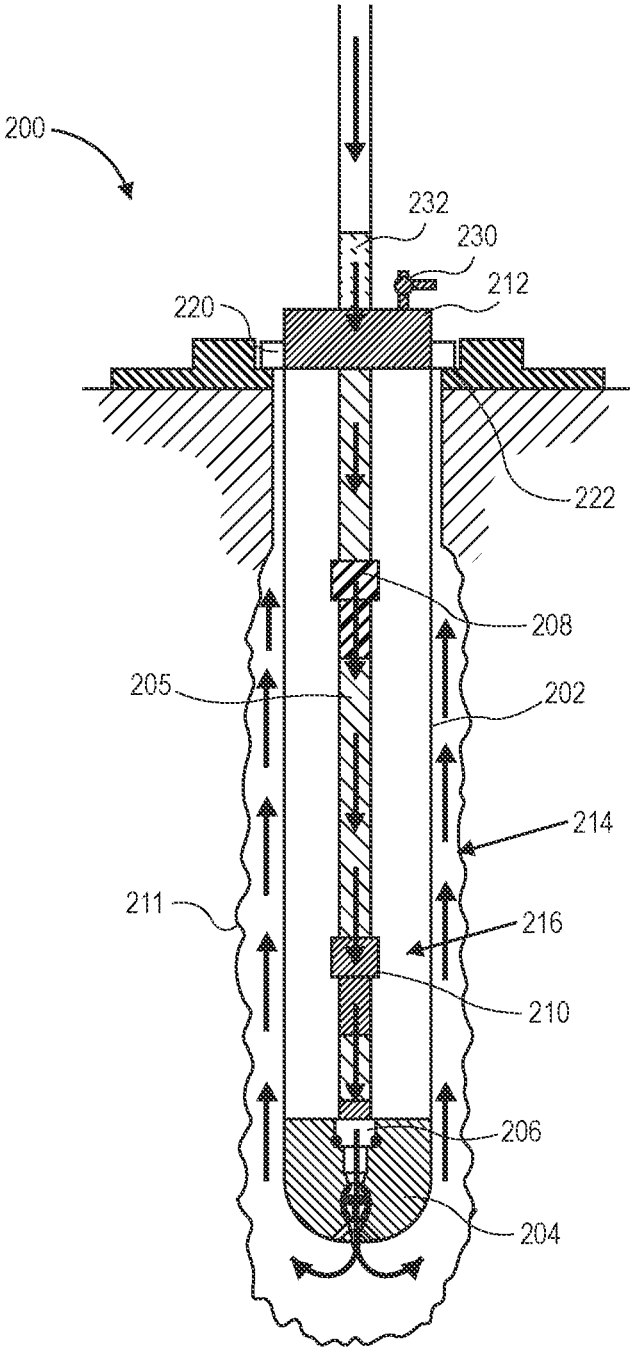
FIG. 4 illustrates a schematic side view of the cementing system in the third state, with fluid circulating into an outer annulus via the inner string and the float shoe, according to an embodiment.

FIG. 4 illustrates a side, schematic view of the cementing system 200 in a third state, according to an embodiment. The casing string 202 has been e lowered along with the inner string 205 and is now in a desired location, e.g., for cementing. At this stage, the inner string 205 may be employed to provide the aforementioned fluid flowpath into the outer annulus 214 via the float shoe 204, indicated by the arrows. Upon reaching a desired location, cement may be pumped through the inner string 205 into the outer annulus 214. Because the stinger 206 is received into and forms a fluid-tight seal with the float shoe 204, the cement (or other fluids) do not flow into the inner annulus 216. Pumping continues until a calculated volume of cement required to fill the outer annulus 214 has been pumped.

Figure 5:
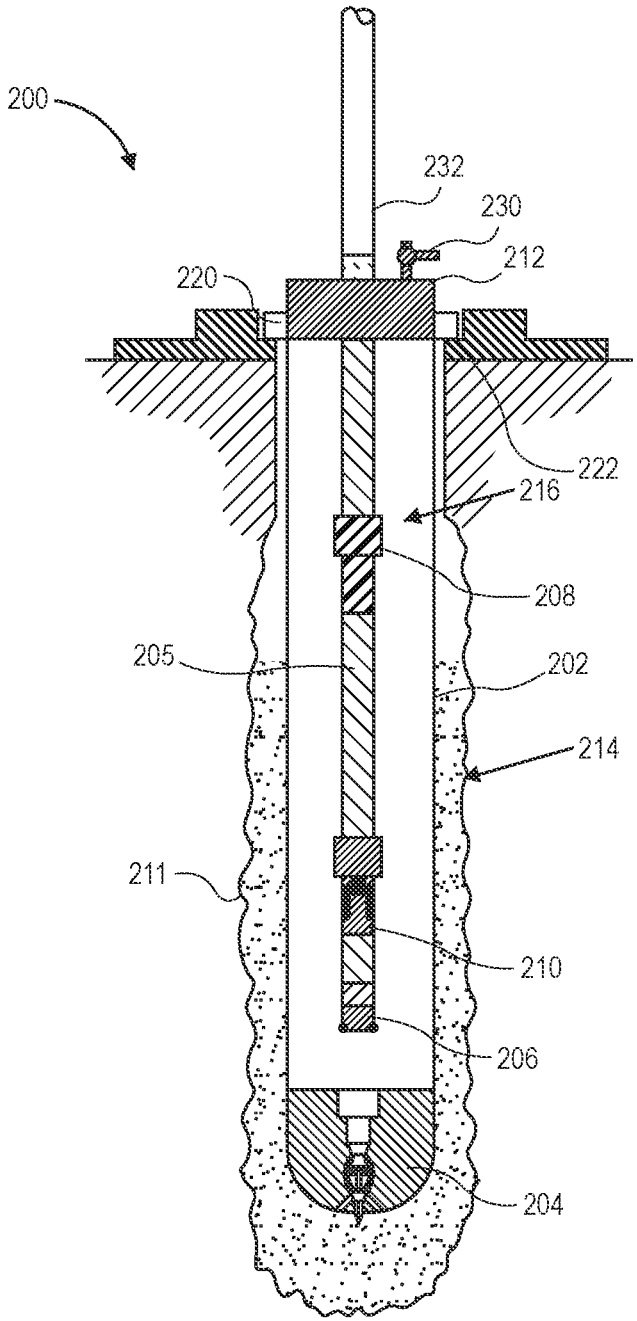
FIG. 5 illustrates a schematic side view of the cementing system in a fourth state, with the stinger retracted from within the float shoe, according to an embodiment.

Proceeding to FIG. 5, once this volume of cement has been pumped a second fluid, e.g., drilling mud may be pumped to displace the cement down thru the inner string 205 and into the outer annulus 214. Included with pumping of the second fluid, a ball 500 (or any other obstructing member) can be pumped or dropped down into the ball seat 226 of the retractable joint 210. Pressure can be applied at the surface against the ball 500, which increases pressure within the inner string 205, and opens a communication port to the working section of the retractable joint 210, thereby permitting pressure from the inner string 205 to retract the joint 210. Once the hydraulic retractable joint 210 is retracted, the retractable joint 210 may be mechanically locked in the retracted position. In other embodiments, the joint 210 may be activated mechanically. In either case, activating the retractable joint 210 reduces the length of the inner string 205. Since the upper end of the inner string 205 is secured to the casing hanger, the lower end of the inner string 205 including the stinger 206 is thus retracted or lifted out of engagement with the float shoe 204. This suspends the inner string 205 above the float shoe 204, exposing the lower end of the inner string 205.

In another embodiment, a two-piece stinger may be employed, in which the lower portion thereof remains within the float shoe 204, and overpull or slack-off weight allows the upper portion of the stinger 206 to remain with the inner string 205 as the inner string 205 is pulled up. This parting of the stinger may permit flow into the inner annulus 216. In this embodiment, the inner string 205 may part at the stinger 206, exposing the interior of the inner string 205 to the inner annulus 216 by disconnecting a lower portion of the inner string 205 from an upper portion thereof. For example, this can be done mechanically or hydraulically by moving down and releasing the lower PDC drillable portion of the cement stringer 205 from the upper portion. For example, the upper portion can be connected to the lower portion via shear screws or other frangible members (e.g., a mechanically-separable connection), such that force (e.g., tension or compression) applied to the inner string 205 yields the screws (or otherwise breaks the frangible members) and permits separation of the upper (non-drillable) portion of the stinger 206 from the lower (drillable) portion of the stinger 206.

Figure 6:
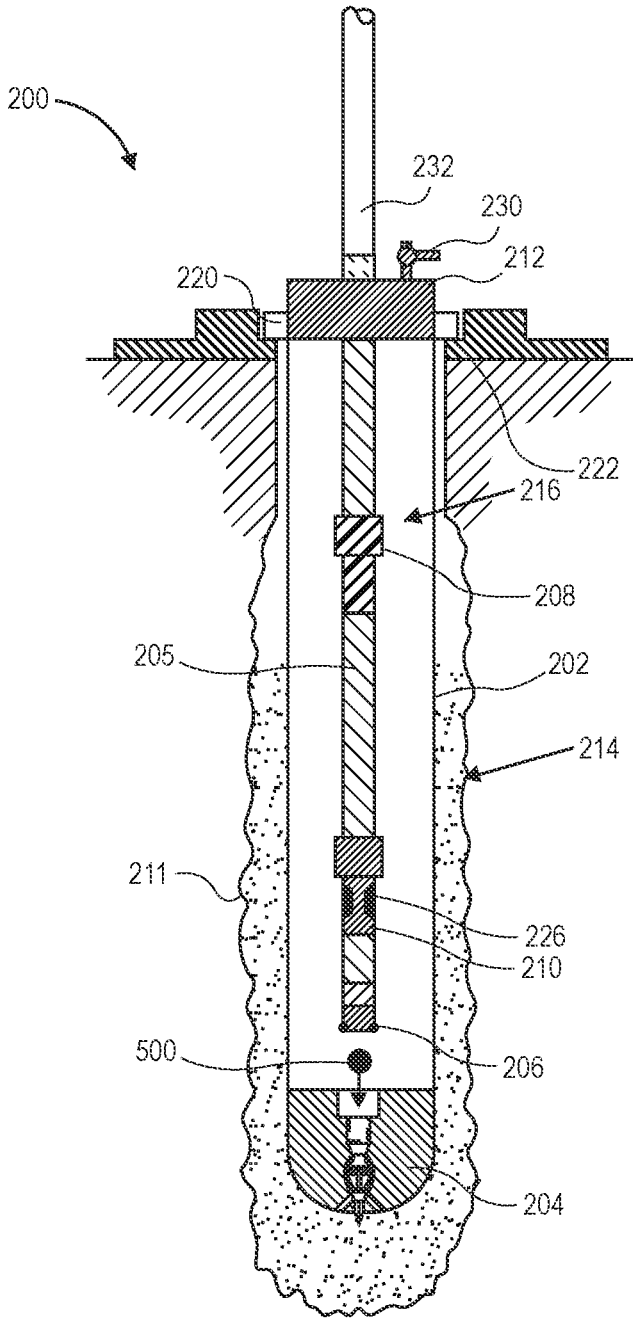
FIG. 6 illustrates a schematic side view of the cementing system in a fifth state, with a ball extruded through a seat and advancing toward the float shoe, according to an embodiment.
Figure 7:
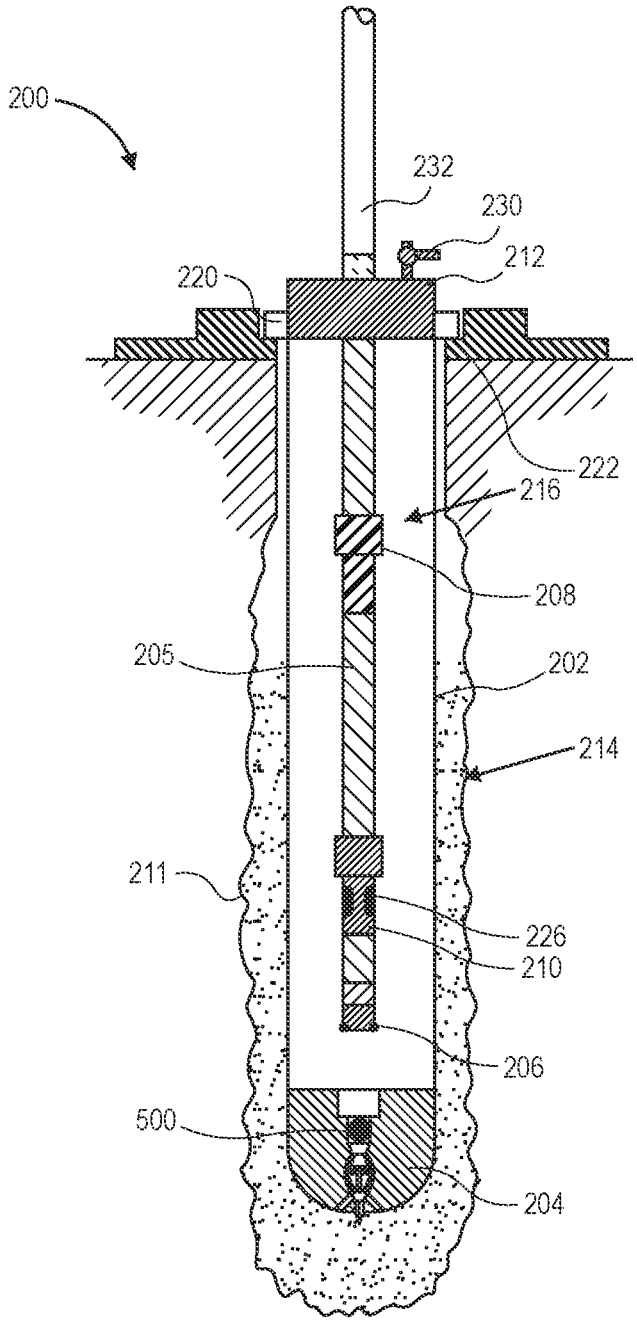
FIG. 7 illustrates a schematic side view of the cementing system in a sixth state, with the ball landed in the float shoe, according to an embodiment.

As shown in FIG. 6, additional pressure is applied at surface to force the ball 500 through the ball seat 226, the bottom of the inner string 205 and through the stinger 206. This may be referred to as "extruding" the ball seat 226 to permit passage of the ball 500. Once the seat 226 has been extruded, the ball 500 may flow or fall down to another seat formed in the float shoe 204, as shown in FIG. 7. The ball 500 thus seals off the inner diameter of the float shoe 204 and allows the inner annulus 216 to be pressurized. Fluid can now be circulated out of the end of the inner string 205 and into the inner annulus 216.

Thus, at this stage, the interior of the inner string 205 is in communication with the interior of the casing string 202, e.g., by parting stringer 206 and/or the inner string 205 or lifting the stinger 206 from within the float shoe 204 (as shown). Further, the float shoe 204 may be blocked by the ball 500. In such examples, pressurized fluid may be pumped into the casing string 202 via the inner string 205. This may permit a casing pressure test, for example, to be completed, without having to wait for the cement to fully set, as is generally the case with prior art systems. Sometimes, but not by way of limitation, such pressure testing can cause the large-diameter casing string 202 to expand. If the cement has already hardened in the outer annulus 214 such expansion can create micro-cracks in the cement, which may provide fluid flowpaths therethrough, permitting fluids to leak through the outer annulus 214. By contrast, because the ball 500 in the float shoe 204 prevents fluid flow to the outer annulus 214, operators may proceed with pressure testing without waiting for cement in the inner annulus 216 to harden (as there may not be any there), and thus the aforementioned expansion of the casing string 202 may cause the casing string 202 to press against "green" (e.g., not fully hardened) cement, that may be more compliant and crack-resistant. Once the pressure testing of the casing string has been successfully completed the elevated test pressure on the interior of the casing string is relieved and the casing string is returned to its relaxed state.

Further, if the float equipment fails to hold backpressure, fluid pressure from the surface can be pumped into the inner string 205 to prevent cement from flowing back into the casing string 202 until the cement hardens (to support the weight of the casing and isolate the annulus outside of the casing string 202), or a latching dart (in lieu of a ball) can be used to hold backpressure. If it is desirable to pump fluid into the inner annulus and circulate it out of the inner annulus 216 the vent valve 230 at the casing hanger running tool 212 can be opened, via use of a remotely operated vehicle (ROV), to permit circulation of a fluid into the inner annulus 216.

Finally, the inner string 205, and casing hanger running tool 212 can be removed from the casing string 202, permitting drill out of the float shoe 204 and continued drilling operations to advance the wellbore 211 farther into the earth.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

While the present teachings have been illustrated with respect to one or more implementations, alterations and/or modifications may be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. A method comprising:

deploying an inner string including a stinger and a retractable joint into a casing string, wherein a float shoe is connected to the casing string and permits one-way fluid communication from within the inner string to an outer annulus between a wellbore and the casing string;

receiving the stinger into the float shoe;

reducing an axial length of the inner string, after receiving the stinger into the float shoe, using a slip joint coupled to the inner string, wherein reducing the axial length permits a casing hanger running tool to be made-up to a casing hanger while the stinger is received into the float shoe;

circulating fluid through the inner string, the stinger, and the float shoe, into the outer annulus, wherein the fluid does not communicate with an inner annulus defined between the inner string and the casing string;

retracting the retractable joint, wherein retracting the retractable joint causes the stinger to be withdrawn from the float shoe; and circulating fluid through the inner string and into an interior of a casing after withdrawing the stinger from within the float shoe.

2. The method of claim 1, wherein the fluid comprises cement or another settable fluid configured to secure the casing string in the wellbore.

3. The method of claim 1, wherein retracting the retractable joint comprises:

catching an obstruction member in a seat of the retractable joint; and applying a pressure through the inner string to the obstruction member.

4. The method of claim 3, further comprising:

causing the obstruction member to pass through the seat after retracting the retractable joint;

blocking the float shoe using the obstruction member; and pressurizing the inner annulus while the obstruction member blocks the float shoe.

5. The method of claim 1, further comprising:

disconnecting a lower portion of the inner string from an upper portion thereof while the inner string is at least partially positioned in the casing string;

removing the upper portion, but not the lower portion, from the casing string after disconnecting the lower portion from the upper portion; and drilling out the lower portion after removing the upper portion.

6. The method of claim 1, further comprising circulating fluid through the inner annulus and out of a vent valve coupled to a casing hanger running tool.

7. A cementing system comprising:

an inner string configured to be received into a casing string in a wellbore;

a stinger coupled to the inner string and configured to be received into a float shoe connected to the casing string; and a retractable joint coupled to the inner string, wherein the retractable joint is configured to reduce in axial length so as to permit at least part of the stinger to be withdrawn from engagement with the float shoe while a weight of the inner string is supported by a hanger running tool and a casing hanger connected to the casing, wherein the retractable joint comprises a seat that is configured to receive an obstruction member, wherein, when the seat receives the obstruction member, a pressure in the inner string causes the retractable joint to reduce in axial length and into an inner annulus wherein the inner string, the stinger, and the retractable joint form at least a part of a flowpath that extends through an end of the casing string at the float shoe, such that fluid is permitted to flow through the inner string and the float shoe and into an outer annulus defined outside of the casing string, without flowing into the inner annulus defined between the inner string and the casing string.

8. The cementing system of claim 1, wherein the retractable joint is configured to be mechanically locked after reducing in axial length, so as to prevent the retractable joint from increasing in axial length.

9. The cementing system of claim 1, wherein the seat is configured such that increased application of pressure causes the obstruction member to pass through the seat and engage the float shoe, and wherein the obstruction member engaging the float shoe prevents fluid communication from within the casing string to the outer annulus.

10. The cementing system of claim 1, further comprising:

a slip joint coupled to the inner string; and a casing hanger running tool coupled to the inner string, wherein the slip joint is configured to reduce in axial length so as to permit the casing hanger running tool to be connected to the casing hanger, so as to support at least a portion of the weight of the inner string from the casing hanger in tension.

11. The cementing system of claim 7, wherein the inner string includes an upper portion, a lower portion, and a mechanically-separable connection between the upper and lower portions, the lower portion being connected to the stinger and being made from a drillable material, and the connection permitting the upper and lower portions to be disconnected in the well.

* * * * *